United States Patent [19]

Steingroever

[11] 3,985,843

[45] Oct. 12, 1976

[54] PROCESS FOR MOLDING RING MAGNETS FOR RADIALLY ORIENTED PARTICLES

[75] Inventor: Erich Steingroever, Bonn, Germany

[73] Assignee: Magnetfabrik Bonn GmbH vorm. Gewerkschaft Windhorst, Bonn am Rhein, Germany

[22] Filed: Nov. 11, 1974

[21] Appl. No.: 522,873

Related U.S. Application Data

[63] Continuation of Ser. No. 289,315, Sept. 15, 1972, abandoned.

[30] Foreign Application Priority Data

Sept. 17, 1971 Germany ..... 2146552

[52] U.S. Cl. ..... 264/24; 264/111

[51] Int. Cl.[2] ..... B22F 1/00

[58] Field of Search ..... 264/24, 111

[56] References Cited

UNITED STATES PATENTS

| | | | |
|---|---|---|---|
| 3,274,303 | 9/1966 | Muller | 264/24 |
| 3,564,654 | 2/1971 | Steingroever | 264/24 |

*Primary Examiner*—Robert F. White
*Assistant Examiner*—T. E. Balhoff
*Attorney, Agent, or Firm*—George H. Mitchell, Jr.

[57] ABSTRACT

This invention makes it possible to use mechanically hard magnetic materials in the formation of one, or both, of the annular press rams used in closing the mold because at least one of the rams is not permitted to enter the mold a distance sufficient to short circuit the magnetic flux flowing radially between the center ram and the outer wall of the mold.

9 Claims, 1 Drawing Figure

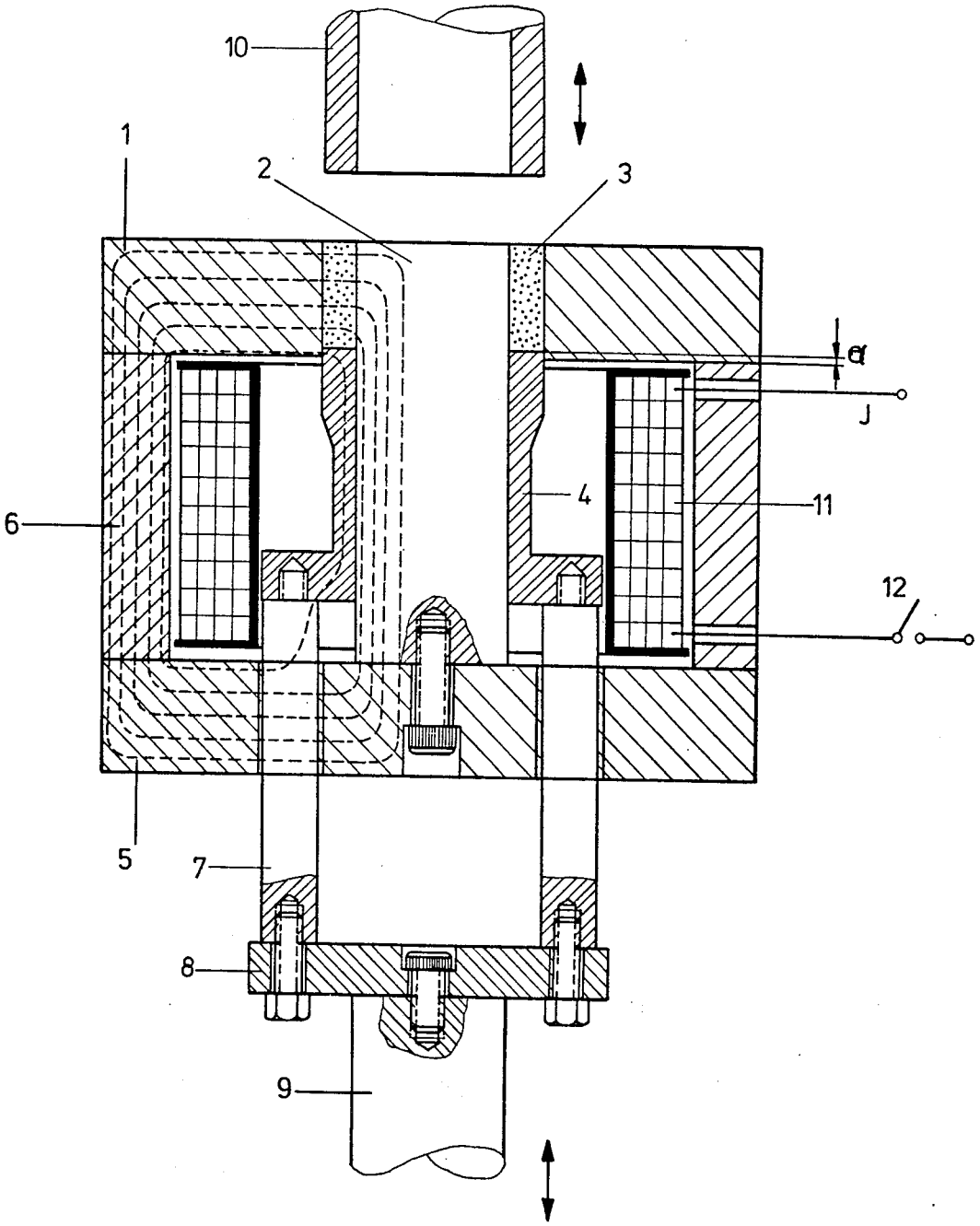
10
1
2
3
a
J
4
11
6
12
5
7
8
9

PROCESS FOR MOLDING RING MAGNETS FOR RADIALLY ORIENTED PARTICLES

This is a continuation of application Ser. No. 289,315, filed Sept. 15, 1972, now abandoned.

The invention relates to apparatus and a process for the molding of ring magnets having radially oriented particles from powdered permanent magnet raw material, preferably from materials having a coercive field intensity $_JH_C$ of more than 1000 A/cm.

Apparatus for molding ring magnets are known already, per se. They consist of a circular mold with a center ram, which between them constitute an annular molding cavity, which is closed on the bottom by a lower press ram. The mold and center ram are made of magnetic raw material and constitute the poles of a magnetic circuit, the magnetic flux of which is excited by a current coil disposed around the center ram below the circular mold. The magnetic powder that is to be processed is filled into the annular press cavity, then the radial magnetic directional field is produced in the coil by turning on the current, as a result of which the powder particles, being magnetically grain oriented, are aligned in a radial direction. Now, by lowering an annular upper ram, the powder is compressed in the press cavity and as a result of that a ring shaped magnetic body is produced.

Heretofore it was a requirement that the two press rams consist of a nonmagnetic raw material in order to avoid a short circuit of the magnetic directional field in the press cavity (for example, DAS No. 1,134,773). Such press rams of nonmagnetic raw material have only a low mechanical strength, for example, in the range of HRC 30 – 50, so that they are subject to very considerable wear.

The present invention recognized that in the case of magnetic rams in alignment of the powder particles in the press cavity is also possible. The invention consists in the fact that an arrangement for molding of ring magnets which are radially grain oriented from powdered permanent magnet raw material with a coercive field intensity of $_JH_C$ of more than 1000 A/cm is characterized by the effect of a radial magnetic field running between an inner pole core and an outer press mold and by two annular press rams made of magnetic raw material, of which only one dips preferably only a little into the press cavity during alignment of the powder particles.

The aligning of the powder particles will surprisingly be impeded only by a small amount by the press ram closing the press cavity in a downward direction so long as the ram projects approximately no more than about 1 – 5 mm into the press cavity, because a magnetic saturation of the submerging zone of the press ram prevents an essential short circuit of the magnetic flux. It may even occur that the magnetically conductive lower ram conducts more additional magnetic flux through a cross section than is shunted at its point of contact with the outside mold wall, so that altogether an increase of the effective directional field intensity occurs in the press cavity. During this alignment of the powder particles there is no need for the upper press ram to be submerged into the press cavity and therefore it cannot impede the magnetic directional field. It turned out surprisingly that the alignment is not disturbed thereafter when the upper press ram compresses the powder. This is the case even though the directional field is turned off either during, or prior to, pressing. The alignment of the powder particles produced by the directional field is not impeded either by pressing from both sides with both press rams being movable with a "floating mold".

The advantage of the invention is to be seen in that press rams made of magnetic raw material can be produced with great strength and great hardness, especially with HRC > 60, which are subject to less wear than rams made of nonmagnetic, less solid and softer raw materials.

A preferred embodiment of the invention is shown in the single FIGURE, by way of example.

In the single FIGURE the annular press cavity is defined by the cylindrical opening in the center of the mold 1 and the outer surface of the cylindrical center ram 2. The bottom of the press cavity is defined by the upper end of a vertically movable annular press ram 4, while the top of the cavity may be closed by the lower end of a vertically movable annular press ram 10.

The mold 1 comprises a generally disc-shaped plate of magnetic material and a similar plate 5 of magnetic material is connected thereto by means of a cylindrical spacer member 6, also composed of magnetic material. The center ram 2, also formed of magnetic material is secured at its lower end to the center of the lower plate 5.

The lower ram 4 surrounds the center ram and terminates at its lower end above the surface of the plate 5 at which location it is attached to the upper ends of a pair of elongated bolts 7 which extend downwardly through suitable openings provided in the plate 5. These bolts are attached at their lower ends to another plate 8 which is carried by the upper end of the vertically movable ram 9 of a molding press (not shown).

Surrounding the lower ram 4 and disposed between the plates 1 and 5 is an annular coil 11 which is connected to a source of electrical energy (not shown) through an electrical circuit which includes the switch 12, so that when the switch is closed a radially directed magnetic field is established in the press cavity 3 whose lines of flux are schematically indicated by the broken lines (shown in the drawing only to the left of the center line of the FIGURE.

It will thus be seen that substantially all of the flux path is contained within the elements 1, 2, 5 and 6 and that only a relatively small portion passes through the upper end of the lower press ram 4 between the upper plate 1 and center ram 2 because the magnetic flux saturates the upper end of ram 4.

In normal operation it is preferable to restrict the movement of ram 4 upwardly in cavity 3 to a small distance represented by the spaced lines *a* at the right of the FIGURE. In the case of magnets whose diameters are in the range of 25 – 50 mm the amount of penetration could be within the range of 1 – 5 mm.

As stated above, the upper end of the cavity 3 is closed by the annular ram 10 which is secured to another vertically movable element of the molding press (not shown), and when the upper press ram 10 is moved downwardly to close the opening at the top of the cavity, it will be evident that there is substantially no flux path formed between mold 1 and center ram 2 at the upper end of cavity 3 other than directly through the magnetic particles in the cavity in radial directions. Furthermore, if the energy supplied to coil 11 is sufficient to magnetically saturate the element 2, any further downward movement of ram 10 to complete the pressing of a magnet will not distort the radial orientation of the lines of force through the cavity.

Because of the aforementioned design of the apparatus, it is therefore possible to fabricate the annular press rams 4 and 10 (or at least those portions of the rams which enter the cavity 3) of mechanically hard materials which are usually also highly magnetically permeable such as steel having a hardness greater than HRC 60. Obviously, the other elements forming the cavity, or those portions defining the cavity, would also be formed from materials having high mechanical strength and resistance to abrasion.

In operation, the lower ram is first moved into a position to close the bottom of the cavity which, in the case of small magnets, may mean that it protrudes upwardly less than 1 mm into the cavity. Thereafter the cavity 3 is filled with a charge of powdered raw magnetic material. After the charge is in place the coil is energized to align the particles in radial directions in the cavity. Finally, the upper ram 10 is moved downwardly into the cavity to complete the pressing. During the pressing the coil may remain energized but even if it is deenergized, by opening switch 12, before the ram 10 begins compacting the particles it has been found that their radial alignments are not disturbed by the force of compaction. The formed magnet may be removed by retracting the ram 10 and moving the lower ram 4 upwardly to push the magnet out of the cavity.

The invention consists also in using magnetic material only for the upper ram 10, while the lower ram 4 may be made of nonmagnetic material. The inventor has found, that the previous radial alignment of the powder particles magnetic axes is not disturbed when the upper punch 10 enters the mold and acts on the powder.

I claim:

1. In a process for compression molding ring-shaped permanent magnets having radially oriented particles, the final product having a coercive field intensity $_JH_C$ of more than 1000 A/cm using a press having a mold cavity in which the outer periphery of the magnet is defined by a cylindrical opening in a horizontal plate of abrasion resistant magnetically permeable material said plate forming the upper portion of a closed generally toroidally shaped magnetic path including lines of force flowing in radial directions through the mold defined in part by said horizontal plate, the return portion of said path being disposed below said plate, the inner periphery of said magnet being defined by a cylindrical ram of abrasion resistant magnetically permeable material disposed concentrically with said opening and forming another portion of said magnetic path, said press also including upper and lower annular rams surrounding the cylindrical ram and axially movable into the annular space in said plate to form the respective end walls of a magnet, and means for energizing a magnetic field having lines of force following said closed toroidally shaped path, the improvement which comprises the steps of using a lower ram of abrasion resistant magnetically permeable material, and positioning the upper surface of said lower ram within the mold at a distance above the lower surface of the mold sufficient to close the mold prior to introducing powdered magnetic raw material into the cavity thus formed and insufficient to significantly distort the radial direction of said lines of force through the lower end of the mold.

2. Process of claim 1, which includes the step of energizing said magnetic field at a value sufficient to magnetically saturate said cylindrical ram.

3. Process of claim 2, which includes the step of positioning the upper surface of the lower ram at a distance above the lower surface of the mold which is less than 5mm.

4. Process of claim 3, which includes the step of energizing said magnetic field at a value sufficient to magnetically saturate said cylindrical ram.

5. Process of claim 4, in which said lower ram comprises steel having a hardness of at least HRC 60.

6. Process of claim 1, in which said distance above the lower surface of the mold is within the range of 1–5mm.

7. Process of claim 6, in which the diameter of the mold is within the range of 25–50mm.

8. Process of claim 6, which includes the step of energizing said magnetic field at a value sufficient to magnetically saturate said cylindrical ram.

9. Process of claim 8, in which said lower ram comprises steel having a hardness of at least HRC 60.

* * * * *